US008197428B2

(12) United States Patent
Helgeson et al.

(10) Patent No.: US 8,197,428 B2
(45) Date of Patent: Jun. 12, 2012

(54) PORTABLE AIR PULSATOR AND THORACIC THERAPY GARMENT

(75) Inventors: Lonnie J. Helgeson, New Prague, MN (US); Michael W. Larson, New Prague, MN (US)

(73) Assignee: Electromed, Inc., New Prague, MN (US)

( * ) Notice: Subject to any disclaimer, the term of this patent is extended or adjusted under 35 U.S.C. 154(b) by 1084 days.

(21) Appl. No.: 11/906,793

(22) Filed: Oct. 3, 2007

(65) Prior Publication Data

US 2009/0093740 A1 Apr. 9, 2009

(51) Int. Cl.
*A61H 7/00* (2006.01)
*A61H 19/00* (2006.01)

(52) U.S. Cl. ..... 601/152

(58) Field of Classification Search ..... 601/89, 601/107, 148–152
See application file for complete search history.

(56) References Cited

U.S. PATENT DOCUMENTS

| | | | | |
|---|---|---|---|---|
| 1,147,560 | A * | 7/1915 | Shurtleff | 601/152 |
| 4,135,503 | A | 1/1979 | Romano | |
| 4,715,573 | A * | 12/1987 | Liegel | 248/129 |
| 5,769,800 | A | 6/1998 | Gelfand et al. | |
| 5,938,627 | A * | 8/1999 | Hickman | 601/149 |
| 6,036,662 | A | 3/2000 | Van Brunt et al. | |
| 6,155,996 | A | 12/2000 | Van Brunt et al. | |
| 6,254,556 | B1 | 7/2001 | Hansen et al. | |
| D456,591 | S | 5/2002 | Hansen | |
| D461,897 | S | 8/2002 | Hansen et al. | |
| D469,876 | S | 2/2003 | Hansen et al. | |
| 6,605,050 | B2 | 8/2003 | Hansen | |
| 6,676,614 | B1 | 1/2004 | Hansen et al. | |
| D531,728 | S | 11/2006 | Helgeson | |
| 7,490,837 | B2 * | 2/2009 | Pond et al. | 280/47.35 |
| 2005/0070828 | A1 * | 3/2005 | Hampson et al. | 601/152 |

* cited by examiner

*Primary Examiner* — Kristen Matter
(74) *Attorney, Agent, or Firm* — Richard John Bartz

(57) ABSTRACT

A portable human body pulsating apparatus has an air pulse generator mounted on a pedestal having wheels to facilitate movement of the apparatus on a surface. The pedestal has an upright piston and cylinder assembly operable to adjust the elevation of the air pulse generator. A reversible thoracic therapy garment is connected with a hose to an air pulse generator which can be selectively located adjacent opposite sides of a person receiving therapy.

15 Claims, 7 Drawing Sheets

PORTABLE AIR PULSATOR AND THORACIC THERAPY GARMENT

FIELD OF THE INVENTION

The invention relates to a portable medical device operable with a thoracic therapy garment to apply repetitive compression forces to the body of a person to aid blood circulation, loosen and eliminate mucus from the lungs and trachea and relieve muscular and nerve tensions.

BACKGROUND OF THE INVENTION

Clearance of mucus from the respiratory tract in healthy individuals is accomplished primarily by the body's normal mucociliary action and cough. Under normal conditions these mechanisms are very efficient. Impairment of the normal mucociliary transport system or hypersecretion of respiratory mucus results in an accumulation of mucus and debris in the lungs and can cause severe medical complications such as hypoxemia, hypercapnia, chronic bronchitis and pneumonia. These complications can result in a diminished quality of life or even become a cause of death. Abnormal respiratory mucus clearance is a manifestation of many medical conditions such as pertussis, cystic fibrosis, atelectasis, bronchiectasis, cavitating lung disease, vitamin A deficiency, chronic obstructive pulmonary disease, asthma, and immotile cilia syndrome. Exposure to cigarette smoke, air pollutants and viral infections also adversely affect mucociliary function. Post surgical patients, paralyzed persons, and newborns with respiratory distress syndrome also exhibit reduced mucociliary transport.

Chest physiotherapy has had a long history of clinical efficacy and is typically a part of standard medical regimens to enhance respiratory mucus transport. Chest physiotherapy can include mechanical manipulation of the chest, postural drainage with vibration, directed cough, active cycle of breathing and autogenic drainage. External manipulation of the chest and respiratory behavioral training are accepted practices. The various methods of chest physiotherapy to enhance mucus clearance are frequently combined for optimal efficacy and are prescriptively individualized for each patient by the attending physician.

Cystic fibrosis (CF) is the most common inherited life-threatening genetic disease among Caucasians. The genetic defect disrupts chloride transfer in and out of cells, causing the normal mucus from the exocrine glands to become very thick and sticky, eventually blocking ducts of the glands in the pancreas, lungs and liver. Disruption of the pancreatic glands prevents secretion of important digestive enzymes and causes intestinal problems that can lead to malnutrition. In addition, the thick mucus accumulates in the lung's respiratory tracts, causing chronic infections, scarring, and decreased vital capacity. Normal coughing is not sufficient to dislodge these mucus deposits. CF usually appears during the first 10 years of life, often in infancy. Until recently, children with CF were not expected to live into their teens. However, with advances in digestive enzyme supplementation, anti-inflammatory therapy, chest physical therapy, and antibiotics, the median life expectancy has increased to 30 years with some patients living into their 50s and beyond. CF is inherited through a recessive gene, meaning that if both parents carry the gene, there is a 25 percent chance that an offspring will have the disease, a 50 percent chance they will be a carrier and a 25 percent chance they will be genetically unaffected. Some individuals who inherit mutated genes from both parents do not develop the disease. The normal progression of CF includes gastrointestinal problems, failure to thrive, repeated and multiple lung infections, and death due to respiratory insufficiency. While some patients experience grave gastrointestinal symptoms, the majority of CF patients (90 percent) ultimately succumb to respiratory problems.

Virtually all patients with CF require respiratory therapy as a daily part of their care regimen. The buildup of thick, sticky mucus in the lungs clogs airways and traps bacteria, providing an ideal environment for respiratory infections and chronic inflammation. This inflammation causes permanent scarring of the lung tissue, reducing the capacity of the lungs to absorb oxygen and, ultimately, sustain life. Respiratory therapy must be performed, even when the patient is feeling well, to prevent infections and maintain vital capacity. Traditionally, care providers perform Chest Physical Therapy (CPT) one to four times per day. CPT consists of a patient lying in one of twelve positions while a caregiver "claps" or pounds on the chest and back over each lobe of the lung. To treat all areas of the lung in all twelve positions requires pounding for half to three-quarters of an hour along with inhalation therapy. CPT clears the mucus by shaking loose airway secretions through chest percussions and draining the loosened mucus toward the mouth. Active coughing is required to ultimately remove the loosened mucus. CPT requires the assistance of a caregiver, often a family member but a nurse or respiratory therapist if one is not available. It is a physically exhausting process for both the CF patient and the caregiver. Patient and caregiver non-compliance with prescribed protocols is a well-recognized problem that renders this method ineffective. CPT effectiveness is also highly technique sensitive and degrades as the giver becomes tired. The requirement that a second person be available to perform the therapy severely limits the independence of the CF patient.

Persons confined to beds and chairs having adverse respiratory conditions, such as CF and airway clearance therapy, are treated with pressure pulsating devices that subject the person's thorax with high frequency pressure pulses to assist the lung breathing functions and blood circulation. The pressure pulsating devices are operatively coupled to thoracic therapy garments adapted to be worn around the person's upper body. In hospital, medical clinic, and home care applications patients require easy application and low cost disposable thoracic garments connectable to portable air pressure pulsating devices that can be selectively located adjacent the left or right side of the patients.

Artificial respiration devices for applying and relieving pressure on the chest of a person have been used to assist in lung breathing functions, and loosening and eliminating mucus from the lungs of CF persons. Subjecting the person's chest and lungs to pressure pulses or vibrations decreases the viscosity of lung and air passage mucus, thereby enhancing fluid mobility and removal from the lungs. An example of a body pulsating method and device disclosed by C. N. Hansen in U.S. Pat. No. 6,547,749, incorporated herein by reference, has a case accommodating an air pressure and pulse generator. A handle pivotally mounted on the case is used as a hand grip to facilitate transport of the generator. The case including the generator must be carried by a person to different locations to provide treatment to individuals in need of respiratory therapy. These devices use vests having air-accommodating bladders that surround the chests of persons. An example of a vest used with a body pulsating device is disclosed by C. N. Hansen and L. J. Helgeson in U.S. Pat. No. 6,676,614. The vest is used with an air pressure and pulse generator. Mechanical mechanisms, such as solenoid or motor-operated air valves, bellows and pistons are disclosed in the prior art to supply air under pressure to diaphragms and bladders in regular pattern or pulses. Manually operated controls are used to adjust the pressure of the air and air pulse frequency for each patient treatment and during the treatment. The bladder worn around the thorax of the CF person repeatedly compresses and releases the thorax at frequencies as high as 25 cycles per second. Each compression produces a rush of air through the lobes of the lungs that shears the secretions from the sides of the airways and propels them toward the mouth where they can be removed by normal coughing. Examples of chest compression medical devices are disclosed in the following U.S. Patents.

W. J. Warwick and L. G. Hansen in U.S. Pat. Nos. 4,838,263 and 5,056,505 disclose a chest compression apparatus having a chest vest surrounding a person's chest. A motor-driven rotary valve located in a housing located on a table allows air to flow into the vest and vent air therefrom to apply pressurized pulses to the person's chest. An alternative pulse pumping system has a pair of bellows connected to a crankshaft with rods operated with a dc electric motor. The speed of the motor is regulated with a controller to control the frequency of the pressure pulses applied to the vest. The patient controls the pressure of the air in the vest by opening and closing the end of an air vent tube. The apparatus must be carried by a person to different locations to provide treatment to persons in need of respiratory therapy.

M. Gelfand in U.S. Pat. No. 5,769,800 discloses a vest design for a cardiopulmonary resuscitation system having a pneumatic control unit equipped with wheels to allow the control unit to be moved along a support surface.

N. P. Van Brunt and D. J. Gagne in U.S. Pat. Nos. 5,769,797 and 6,036,662 disclose an oscillatory chest compression device having an air pulse generator including a wall with an air chamber and a diaphragm mounted on the wall and exposed to the air chamber. A rod pivotally connected to the diaphragm and rotatably connected to a crankshaft transmits force to the diaphragm during rotation of the crankshaft. An electric motor drives the crankshaft at selected controlled speeds to regulate the frequency of the air pulses generated by the moving diaphragm. A blower delivers air to the air chamber to maintain the pressure of the air in the chamber. Controls for the motors that move the diaphragm and rotate the blower are responsive to the air pressure pulses and pressure of the air in the air chamber. These controls have air pulse and air pressure responsive feedback systems that regulate the operating speeds of the motors to control the pulse frequency and air pressure in the vest. The air pulse generator is a mobile unit having a handle and a pair of wheels.

SUMMARY OF THE INVENTION

The invention is a medical device used to deliver high-frequency chest wall oscillations to promote airway clearance and improve bronchial drainage in humans. The primary components of the device include an air-pulse generator, an air inflatable thoracic garment, and a flexible hose coupling the air-pulse generator to the thoracic garment for transmitting air pressure and pressure pulses from the generator to the thoracic garment. The air-pulse generator is mounted on a portable pedestal having wheels that allow the generator to be moved to different locations to provide therapy treatments to a number of persons. The portable pedestal allows the air-pulse generator to be located adjacent opposite sides of a person confined to a bed or chair. The pedestal includes a linear lift that allows the elevation or height of the air-pulse generator to be adjusted to accommodate different locations and persons. The air-pulse generator includes a housing supporting generator controls for convenient use. The housing has a top handle used to manually transport the air-pulse generator. The housing is supported on and secured to a frame assembly joined to the top of the pedestal. The frame assembly has parallel horizontal members connected to a platform engaging the bottom of the housing of the air-pulse generator. Upright members joined to the horizontal members are fastened to opposite sides of the housing of the air-pulse generator. U-shaped handles joined to and extended outwardly from the upright members provide handles to facilitate movement of the pedestal and air-pulse generator.

The thoracic therapy garment has an elongated flexible body having a plurality of elongated generally parallel chambers for accommodating air. An air inlet connector joined to a lower portion of the body is releasably coupled to a flexible hose joined to the air pulse outlet of the air-pulse generator. One end of the body has hook pads secured to opposite sides of the end to allow the garment to be selectively placed around a person's thorax in clockwise and counterclockwise positions. The outside surface to the body has a loop texture that coacts with the loop pads to retain the garment firmly around the person's thorax. The thoracic therapy garment is reversible with a single air inlet connector that can be accessed from either side of a person's bed or chair. The upper portions of the body have concave arm contours that allow the body to cover upper thorax areas.

DESCRIPTION OF INVENTION

Figure 1:
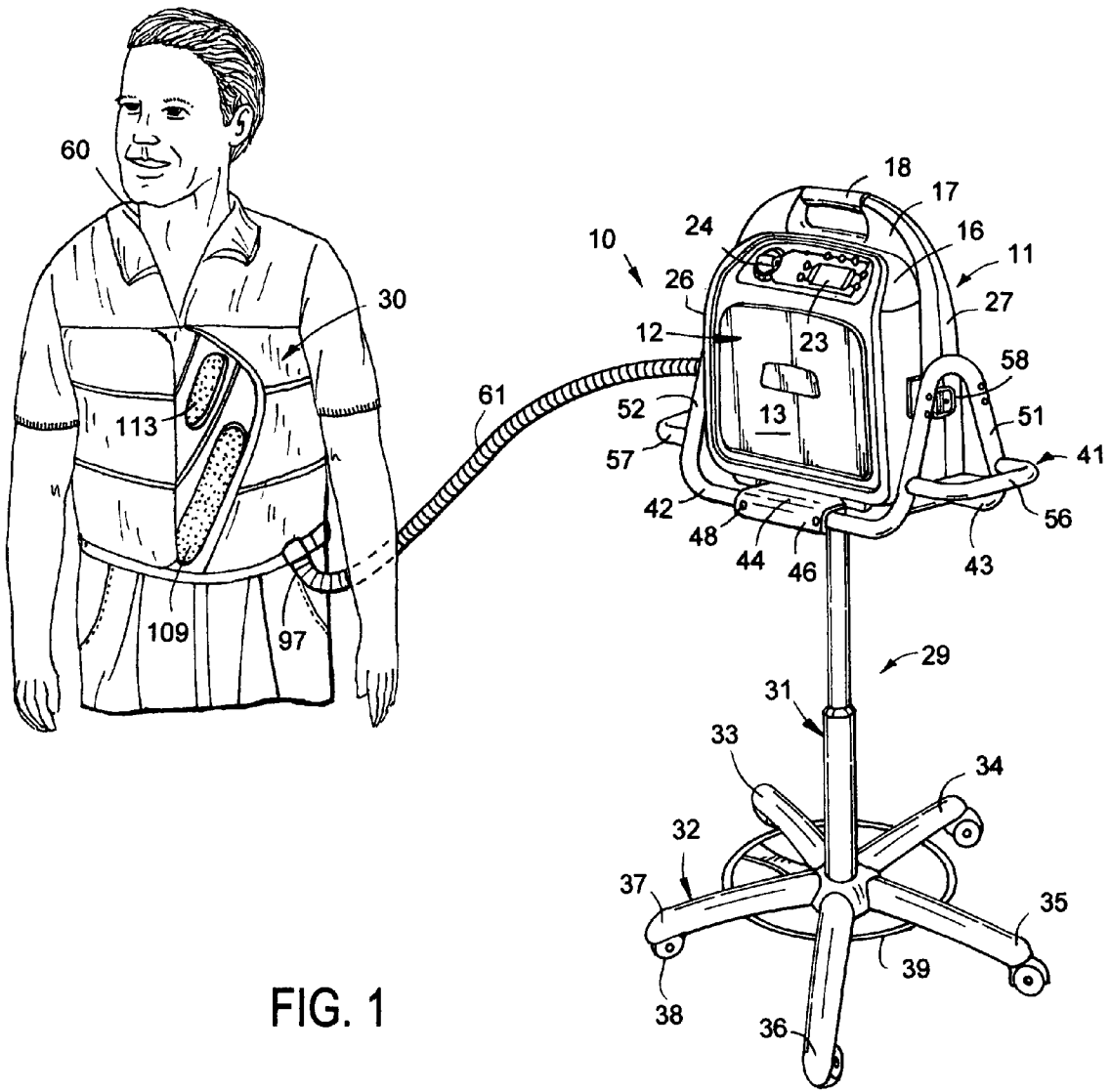
FIG. 1 is a perspective view of a thoracic therapy garment located around the thorax of a person connected with a hose to a pedestal mounted air-pulse generator located on the left side of the person.
Figure 2:
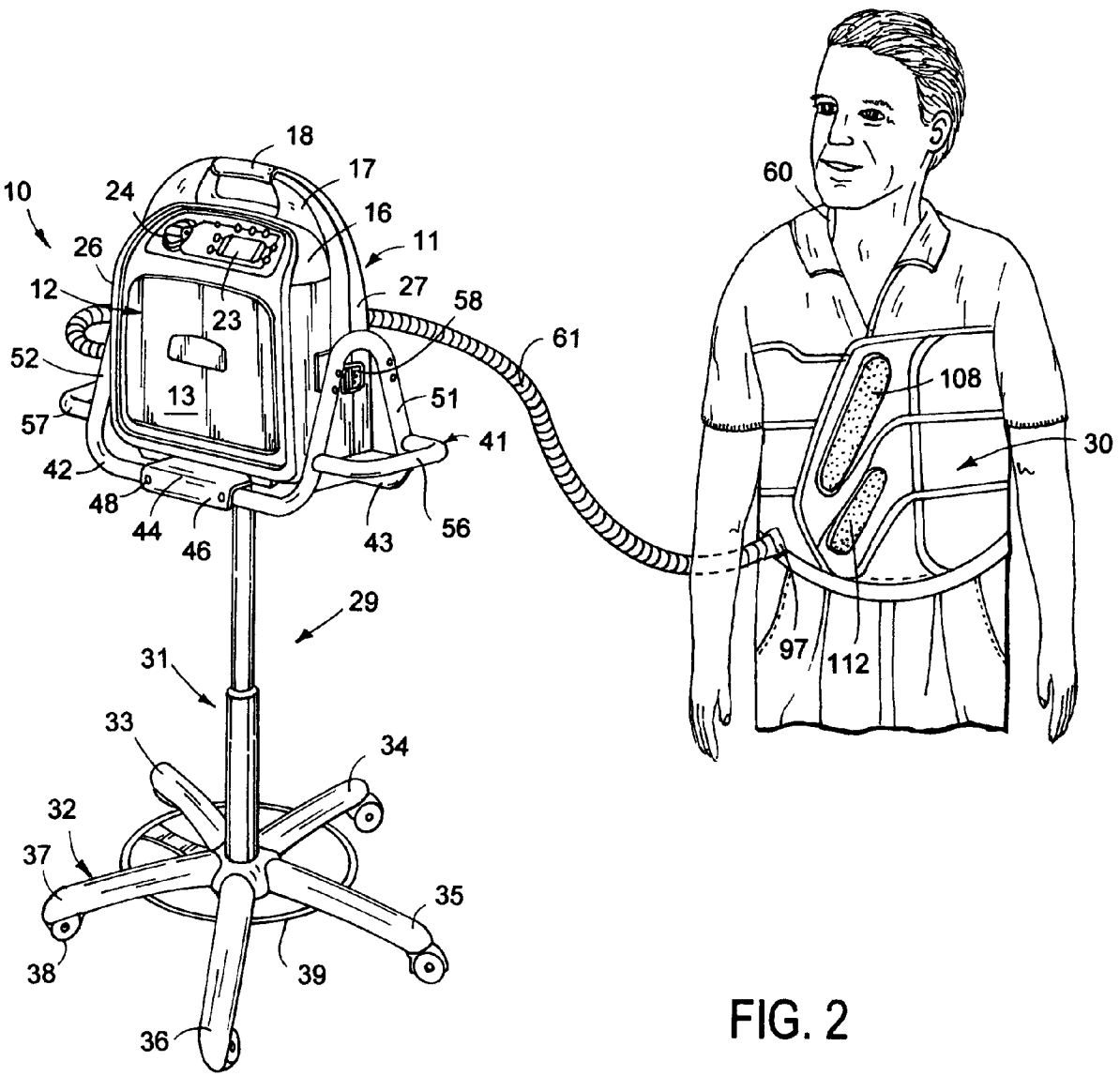
FIG. 2 is a perspective view of the thoracic therapy garment of FIG. 1 located around the thorax of a person connected with a hose to a pedestal mounted air-pulse generator located on the right side of the person.
Figure 4:
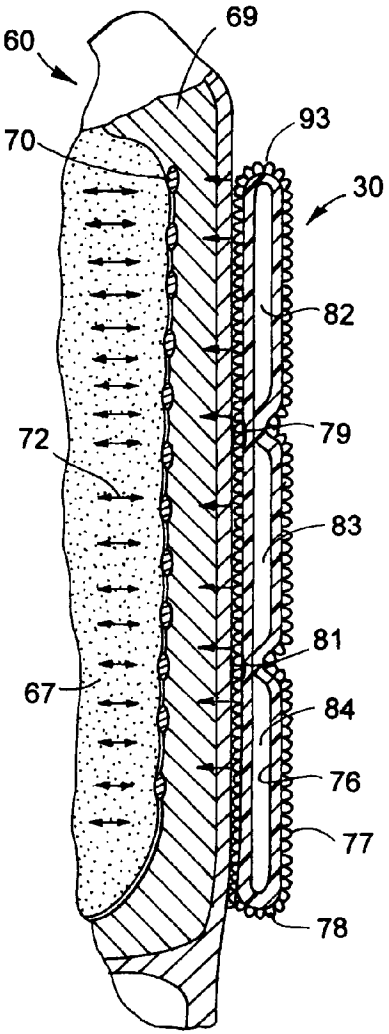
FIG. 4 is an enlarged sectional view of the right side of the person of FIG. 3 with the thoracic therapy garment applying pressure pulses to the person's thorax.

A portable human body pulsating apparatus 10, shown in FIGS. 1 and 2, comprises an air-pulse generator 11 having a housing 12. A movable pedestal 29 supports generator 11 and housing 12 on a surface, such as a floor. Pedestal 29 allows respiratory therapists and patient careperson to transport the entire human body pulsating apparatus to different locations accommodating a number of persons in need of respiratory therapy and to storage locations.

Human body pulsating apparatus 10 is used with a thoracic therapy garment 30 to apply repetitive pressure pulse to a person's thorax to provide secretion and mucous clearance therapy. Respiratory mucous clearance is applicable to many medical conditions, such as pertussis, cystic fibrosis, atelectasis, bronchiectasis, cavitating lung disease, vitamin A deficiency, chronic obstructive pulmonary disease, asthma, and immobile cilia syndrome. Post surgical patients, paralyzed persons, and newborns with respiratory distress syndrome have reduced mucociliary transport. Apparatus 10 provides high frequency chest wall oscillations or pulses to enhance mucus and airway clearance in a person with reduced mucociliary transport. High frequency pressure pulses subject to the thorax in addition to providing respiratory therapy to a person's lungs and trachea, also stimulates the heart and blood flow in arteries and veins in the chest cavity. Muscular and nerve tensions are also relieved by the repetitive pressure pulses imparted to the front, sides, and back portions of the thorax. The lower part of the thoracic cage comprises the abdominal cavity which reaches upward as high as the lower tip of the sternum so as to afford considerable protection to the large and easily injured abdominal organs, such as the liver, spleen, stomach, and kidneys. The abdominal cavity is only subjected to very little high frequency pressure pulses.

Housing 12 is a generally rectangular member having a front wall 13 and side walls 26 and 27 joined to a top wall 16. An arched member 17 having a horizontal handle 18 extended over top wall 16 is joined to opposite portions of top wall 16 whereby handle 18 can be used to manually carry air-pulse generator 11 and facilitate mounting air-pulse generator 11 on pedestal 29. A control panel 23 mounted on top wall 16 has time coated keys and frequency control keys located on opposite sides of a visual control screen. An air pressure control knob 24 is located on the left side of panel 23. The control keys, screen and air pressure control knob are in locations that are readily accessible by the respiratory therapists and user of apparatus 10. The operating elements and functions and controls of air-pulse generator 11 are disclosed by C. N. Hansen, P. E. Cross and L. T. Helgeson in U.S. Patent Application Publication No. 2005/0235988 and incorporated herein by reference. Alternative air pulse generators are disclosed by C. N. Hansen in U.S. Pat. Nos. 6,488,641 and 6,547,749 incorporated herein by reference.

Person care homes, assisted living facilities and clinics can accommodate a number of persons in different rooms or locations that require respiratory therapy or high frequency chest wall oscillations as medical treatments. The portable pulsating apparatus 10 can be manually moved to required locations and connect with a flexible hose 61 to a thoracic therapy garment 30 located around a person's thorax. As shown in FIGS. 1 and 2, pulsating apparatus 10 can be selectively located adjacent the left or right side of a person 60 who may be confined to a bed or chair.

Pedestal 29 has an upright gas operated piston and cylinder assembly 31 mounted on a base 32 having outwardly extended legs 33, 34, 35, 36 and 37. Other types of linear expandable and contractible devices can be used to change the location of generator 11. Caster wheels 38 are pivotally mounted on the outer ends of legs 33-37 to facilitate movement of body pulsating apparatus 10 along a support surface. One or more wheels 38 are provided with releasable brakes to hold apparatus 10 is a fixed location. An example of a pedestal is disclosed in U.S. Pat. No. 5,366,275. The piston and cylinder assembly 31 is linearly extendable to elevate air-pulse generator 11 to a height convenient to the respiratory therapist or user. A gas control valve having a foot operated ring lever 39 is used to regulate the linear extension of piston and cylinder assembly 31 and resultant elevation of generator 11. Generator 11 can be located in positions between its up and down positions. Lever 39 and gas control valve are operative associated with the lower end of piston and cylinder assembly 31.

A frame assembly 41 having parallel horizontal members 42 and 43 and a platform 44 mounts housing 12 on top of upright piston and cylinder assembly 31. The upper member of piston and cylinder assembly 31 is secured to the middle of platform 44. The opposite ends 46 of platform 44 are turned down over horizontal members 42 and 43 and secured thereto with fasteners 48. Upright inverted U-shaped arms 51 and 52 joined to opposite ends of horizontal members 42 and 43 are located adjacent opposite side walls 26 and 27 of housing 12. U-shaped handles 56 and 57 are joined to and extend outwardly from arms 51 and 52 provide hand grips to facilitate manual movement of the air-pulse generator 11 and pedestal 29 on a floor or carpet. An electrical female receptacle 58 mounted on side wall 27 faces the area surrounded by arm 51 so that arm 51 protects the male plug (not shown) that fits into receptacle 58 to provide electric power to air-pulse generator 11. A tubular air outlet sleeve is mounted on side wall 26 of housing 12. Hose 61 leading to thoracic therapy garment 30 telescopes into the sleeve to allow air and air pressure pulses to travel through hose 61 to thoracic therapy garment 30 to apply pressure pulses to a person's body.

Figure 3:
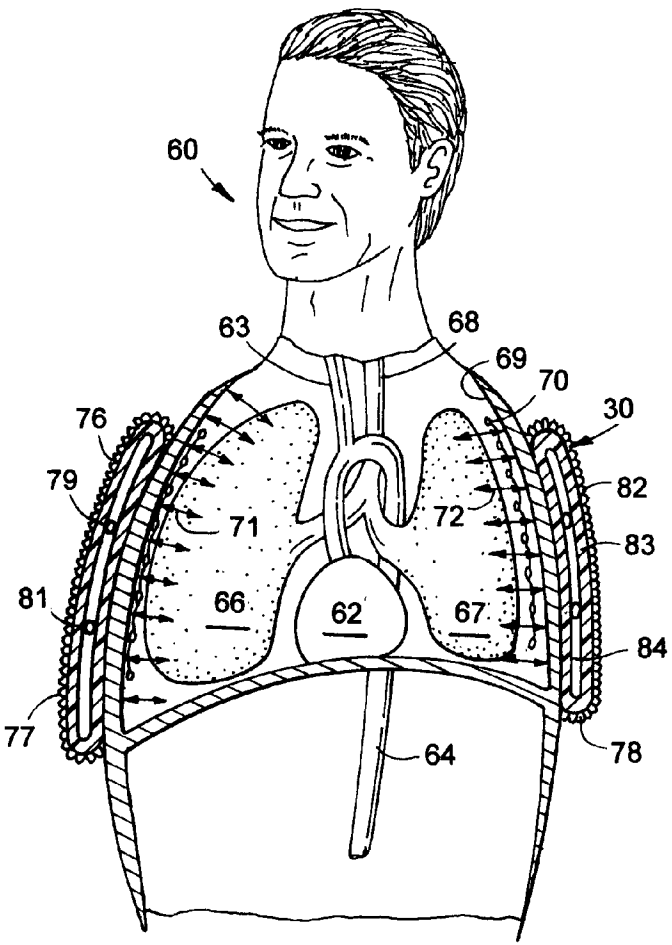
FIG. 3 is a front elevational view, partly sectioned, of the thoracic therapy garment of FIG. 1 located around the thorax of a person.

Thoracic therapy garment 30, shown in FIG. 3, is located around the person's thorax 69 in substantial surface contact with the entire circumference of thorax 69. Thoracic therapy garment 30 functions to apply repeated high frequency compression or pressure pulses, shown by arrows 71 and 72, to the person's lungs 66 and 67 and trachea 68. The reaction of lungs 66 and 67 and trachea 68 to the pressure pulses causes repetitive expansion and contraction of the lung tissue resulting in secretions and mucus clearance therapy. The thoracic cavity occupies only the upper part of the thoracic cage which contains lungs 66 and 67, heart 62, arteries 63 and 64, and rib cage 70. The high frequency pressure pulses applied to thorax 69 stimulates heart 62 and blood flow in arteries 63 and 64 and veins in the chest cavity. Rib cage 70 also aids in the distribution of the pressure pulses to lungs 66 and 67 and trachea 68.

Figure 5:
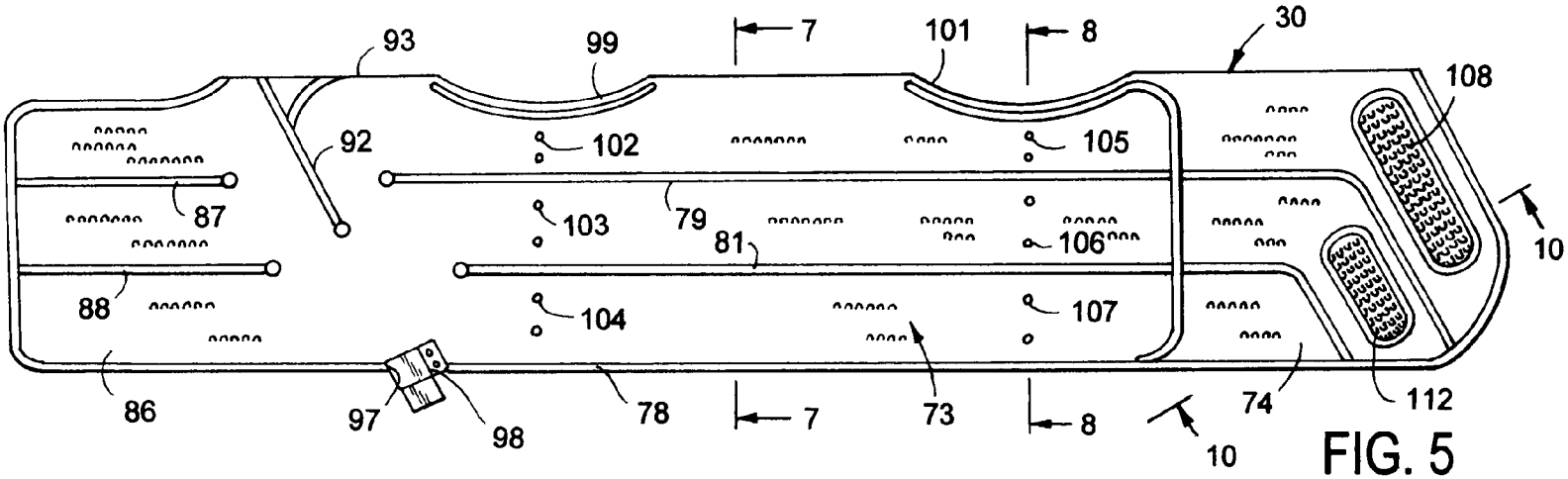
FIG. 5 is a linear front elevational view of the thoracic therapy garment of FIG. 1.
Figure 6:
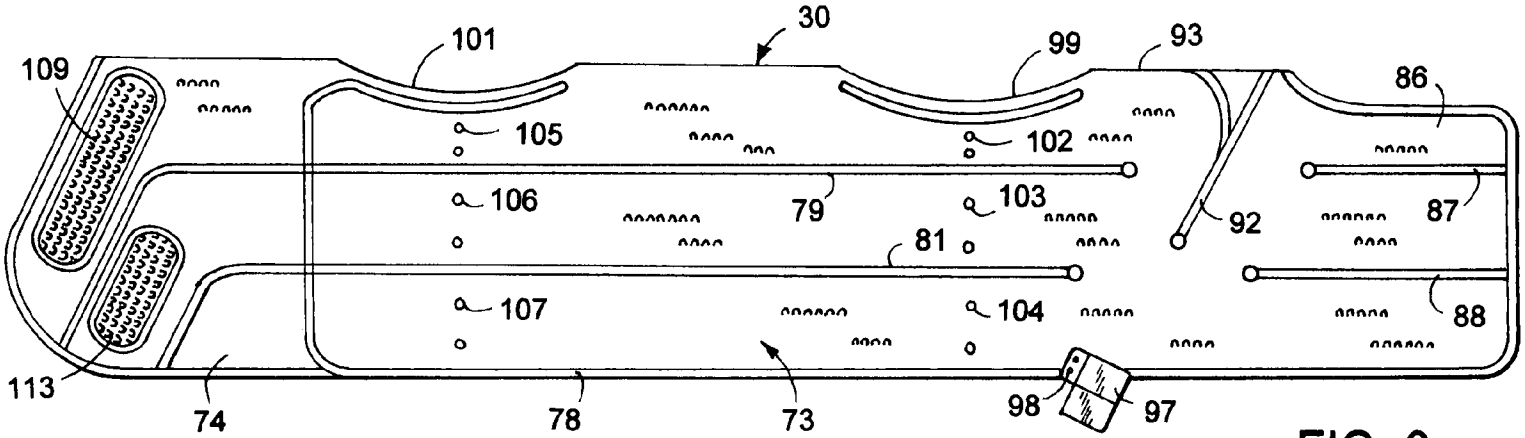
FIG. 6 is a linear rear elevational view of the thoracic therapy garment of FIG. 1.
Figure 8:
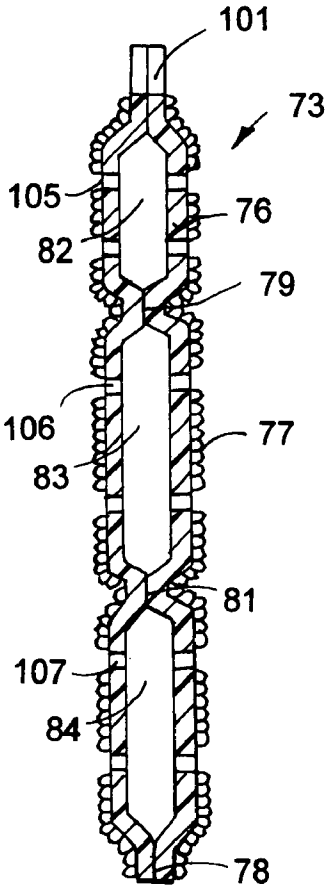
FIG. 8 is an enlarged sectional view taken along the line 8-8 of FIG. 5.
Figure 7:
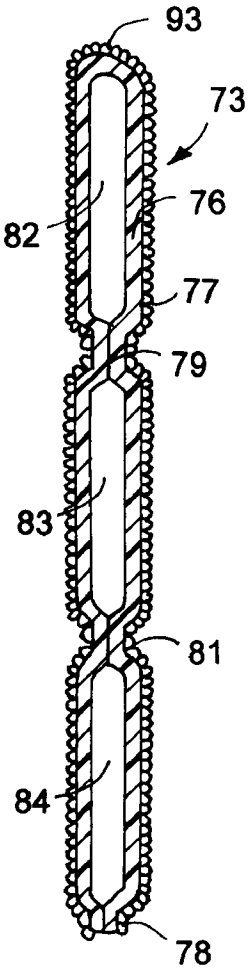
FIG. 7 is an enlarged sectional view taken along the line 7-7 of FIG. 5.
Figure 9:
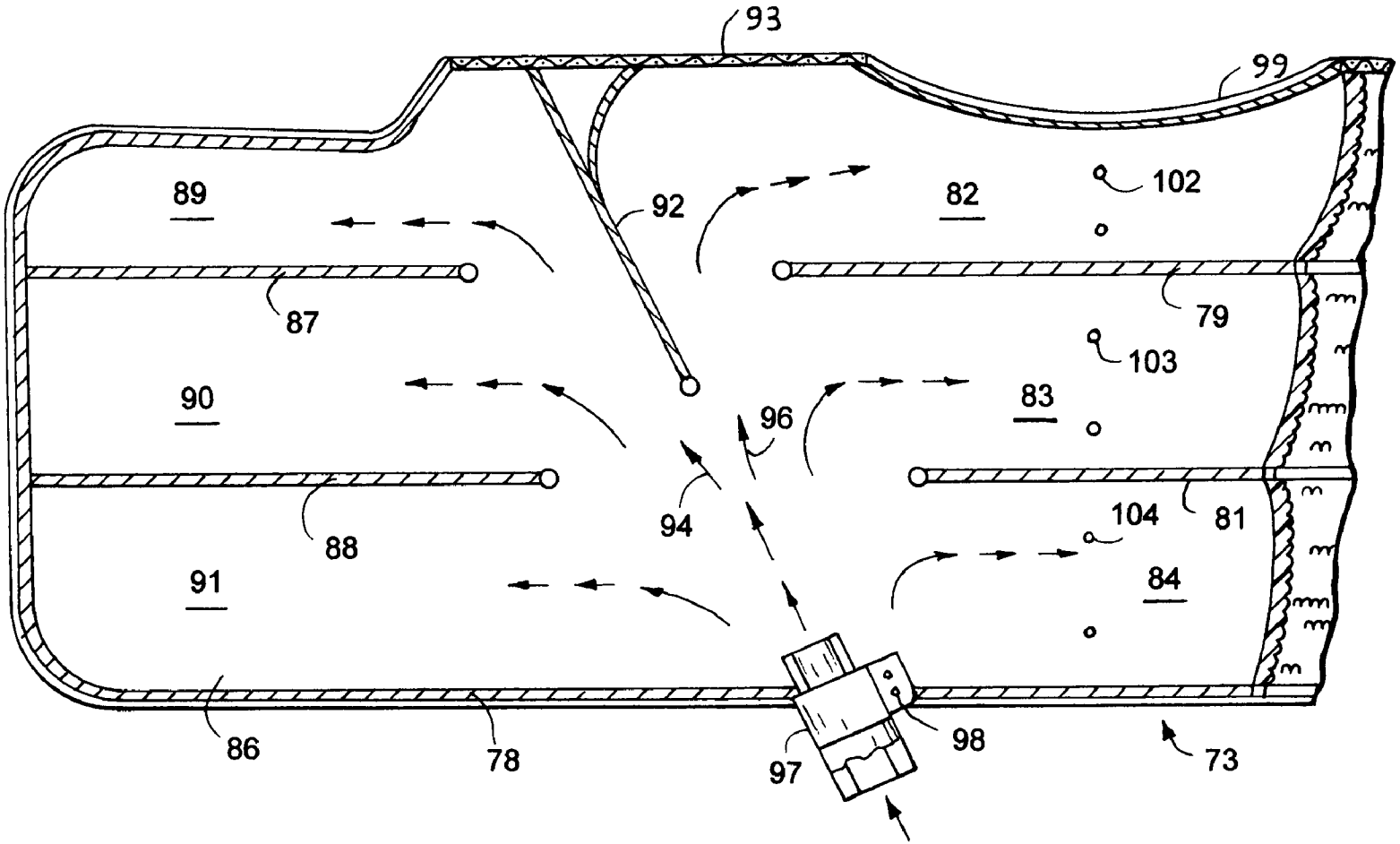
FIG. 9 is an enlarged elevational view, partly sectioned, showing the air pulse inlet section of the thoracic therapy garment of FIG. 1.

As shown in FIGS. 5 and 6, thoracic therapy garment 30 comprises an elongated generally rectangular body 73 including an end flap 74. Body 73, shown in FIGS. 7 and 8, has an inner air impervious flexible member 76 attached to a loop-type fabric member 77. The entire outer surface of member 76 is covered with the loop-type fabric member. The loop fibers can be embedded or fixed into member 76. Member 76 is a flexible plastic layer, such as air impervious urethane plastic. Other types of plastics and materials can be used for air impervious member 76. Returning to FIGS. 5 and 6, body 73 has a longitudinal bottom seam or seal 78 and longitudinal middle seams or seals 79 and 81 which form three longitudinal chambers 82, 83 and 84 for accommodating air. Seams 78, 79 and 81 are linear sonic welds. Heat seals can be used for seams 78, 79 and 81. End 86 of body 73 opposite end 74 has longitudinal seams or seals 87 and 88 longitudinally aligned with seams 79 and 81 which provide air chambers 89, 90 and 91 for air. Seams 79 and 87 and seams 81 and 88 are spaced apart. A diagonal seam or seal 92 extends downwardly from top edge 93 of body 73 to about the middle of body 73. Seam 92, as shown in FIG. 9, is a divider that separates the flow of air shown by arrows 94 and 96 and directs the flow of air into chambers 82, 83, 84, 89, 90 and 91. An air inlet connector 97 secured to the bottom portion of member 76 and seam 78 is adapted to be releasably attached to hose 61. Air flows through connector 97 into body 73. Connector 97 is a tubular member joined to a flange 98 secured to body 73. Other types of hose connectors can be used to accommodate hose 61 and direct air and air pressure pulses into body 73. As shown in FIGS. 1 and 2, connector 97 is coupled to hose 61 when thoracic therapy garment 30 is located clockwise and counterclockwise around the person's thorax. The same connector 97 is coupled to hose 61 when thoracic therapy garment 30 is in reversed use.

Returning to FIGS. 5, 6 and 8, top edge 93 of body 73 has a pair of concave sections 99 and 101 providing recesses or arm contours that increase coverage of the upper thoracic area of the person. The side walls of body 73 below concave sections 99 and 101 have a number of small holes 102-107 for allowing a controlled flow of air from chambers 82, 83 and 84. As shown in FIG. 8, holes 105-107 are open to opposite sides of chambers 82, 83 and 84 to allow air to flow to atmosphere. Air-pulse generator 11 supplies air and air pressure pulses to chambers 82, 83 and 84 and maintains a selected air pressure in chambers 82-84.

Figure 10:
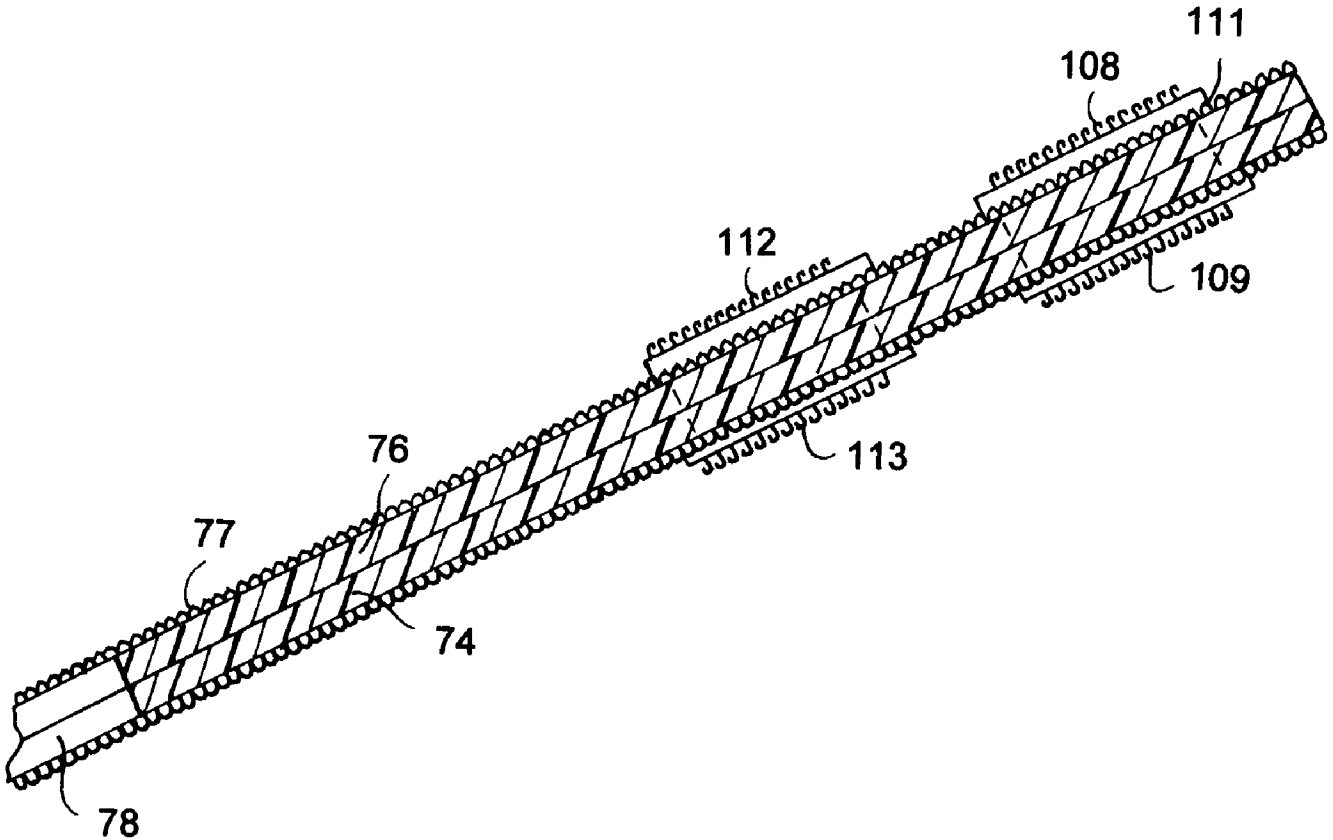
FIG. 10 is an enlarged sectional view taken along the line 10-10 of FIG. 5.

As shown in FIG. 10, a first pair of hook pads 108 and 109 are secured with stitches 111 to opposite sides of end section 74 of body 73. Hook pads 108 and 109, shown in FIGS. 5 and 6, are diagonal generally rectangular releasable fasteners. A second pair of hook pads 112 and 113 are secured with stitches 114 to opposite sides of end section 74 of body 73. Hook pads 108, 109, 112 and 113 can be fastened to opposite sides of end section 74 of body 73 with seams, such as sonic welds or heat seals. In use, hook pads 108 and 112 releasably engage the loop fabric to retain thoracic therapy garment 30 clockwise around the person's thorax. Hook pads 109 and 113 releasably engage the loop fabric when body 73 is reversed to retain thoracic therapy garment 30 counterclockwise around the person's thorax.

There has been shown and described an embodiment of a portable air-pulse generator connected to a thoracic therapy garment for applying high frequency pressure pulses to a person's thorax. Changes in the structure, materials and arrangement of structure can be made by persons skilled in the area without departing from the invention.

The invention claimed is:

1. A portable human body pulsating apparatus and a thoracic therapy garment locatable around the human thorax useable to apply repetitive compression forces to the thorax of a person comprising: a generator for creating air pressure and air pressure pulses, said generator including a housing, a pedestal having an upper end, a frame assembly mounted on the upper end of the pedestal, fasteners securing the housing to the frame assembly, surface support members connected to the pedestal to facilitate movement of the generator on a surface, said thoracic therapy garment including a reversible body having a front surface, a back surface, and a plurality of chambers for accommodating air, an air inlet connector secured to a bottom portion of the body allowing access to the air inlet connector from said bottom portion, the air inlet connector being accessible from said bottom portion when either the front surface or the back surface of the body is located against the person's thorax, the air inlet connector having a passage open to the chambers, and a hose connecting the generator to the air inlet connector whereby air and air pressure pulses created by the generator flow through the hose and air inlet connector into said chambers, the air pressure pulses created by the generator being transferred to the chambers to subject the body to air pressure pulses whereby the thoracic therapy garment is useable to apply repetitive pressure pulses to the thorax of a person when the thoracic therapy garment is located around the thorax of the person regardless of whether the front surface or the back surface of the body is located against the person's thorax.

2. The apparatus and thoracic therapy garment of claim 1 wherein: said pedestal includes an upright piston and cylinder assembly operable to adjust the elevation of the generator, and a base having legs supporting the piston and cylinder assembly, said surface support members comprising wheels mounted on the legs to facilitate movement of the apparatus on a surface.

3. The apparatus and thoracic therapy garment of claim 1 including: at least one handle on the frame assembly to facilitate manual movement of the apparatus.

4. The apparatus and thoracic therapy garment of claim 1 wherein: said pedestal includes an extendable and contractible device connected to the frame assembly operable to adjust the elevation of the generator.

5. The apparatus and thoracic therapy garment of claim 1 wherein: the body has a flexible air impervious member having opposite sides and loop members joined to said opposite sides of the air impervious member, said air impervious member surrounding said chambers, said body including an end section having oppositely facing sides, and hook pads secured to the oppositely facing sides of the end section of the body coacting with the loop members to retain the body around the thorax of the person, the hook pads on the oppositely facing sides of the end section of the body coacting with the loop members to retain the bottom portion of the body adjacent a lower area of the thorax of the person and selectively retain the thoracic therapy garment clockwise or counterclockwise around the thorax of the person.

6. The apparatus and thoracic therapy garment of claim 5 including: seams dividing the body into three chambers and a divider located within the body operable to direct air and air pressure pulses from the air inlet connector into said three chambers.

7. The apparatus and thoracic therapy garment of claim 5 wherein: said body has a longitudinal dimension and laterally spaced seams dividing the body into longitudinal chambers, and a divider within the body operable to direct air and air pressure pulses from the air inlet connector into said chambers.

8. The apparatus and thoracic therapy garment of claim 1 wherein: said body includes a top section having concave recesses providing contours the arms of the person.

9. The apparatus and thoracic therapy garment of claim 1 wherein: said body includes a plurality of holes to allow air to flow out of said chambers.

10. A portable human body pulsating apparatus and a thoracic therapy garment locatable around the thorax of a person useable to apply repetitive compression forces to the thorax of the person comprising:

a generator for creating air pressure and air pressure pulses, the generator including a housing, a pedestal having an upper end, a frame assembly mounted on the upper end, fasteners securing the housing to the frame assembly whereby the generator is supported by the pedestal, surface support members connected to the pedestal to facilitate movement of the pedestal on a surface, a thoracic therapy garment having a body, the body having a plurality of chambers for accommodating air, the body having a bottom portion, an air inlet connector secured to the bottom portion, a hose connecting the generator to the air inlet connector, the air inlet connector having a passage open to the chambers to allow air and air pressure pulses created by the generator to flow from the generator through the hose and air inlet connector into the chambers, the air pressure pulses created by the generator being transferred to the chambers to subject the body to air pressure pulses which applies and releases repetitive pressure pulses to the thorax of the person when the thoracic therapy garment is located around the thorax of the person, the body having a flexible air impervious member having loop members, the body including an end section having a front surface and a back surface facing oppositely from the front surface, first hook pads secured to the front surface of the end section, the first hook pads adapted to coact with the loop members to retain the bottom portion of the body adjacent a lower area of the thorax of the person and retain the thoracic therapy garment clockwise around the thorax of the person, and second hook pads secured to the back surface of the end section, the second hook pads adapted to coact with the loop members to retain the bottom portion of the body adjacent the lower area of the thorax of the person and retain the thoracic therapy garment counterclockwise around the thorax of the person whereby the thoracic therapy garment is reversible.

11. The apparatus and thoracic therapy garment of claim 10 including: seams dividing the body into three chambers and a divider located within the body operable to direct air and air pressure pulses from the air inlet connector into said three chambers.

12. The apparatus and thoracic therapy garment of claim 10 wherein: said body has a longitudinal dimension and laterally spaced seams dividing the body into longitudinal chambers, and a divider within the body operable to direct air and air pressure pulses from the air inlet connector into said chambers.

13. The apparatus and thoracic therapy garment of claim 10 wherein: said body includes a top section having concave recesses providing contours the arms of the person.

14. The apparatus and thoracic therapy garment of claim 10 wherein: said body includes a plurality of holes to allow air to flow out of said chambers.

15. The apparatus and thoracic therapy garment of claim 10 wherein: the first hook pads comprise a first pair of hook pads located on the front surface of the end section of the body, the second hook pads comprising a second pair of hook pads located on the back surface of the end section of the body, and fastening members securing the first and second pairs of hook pads to the front and backs surfaces of the end section of the body.

* * * * *